United States Patent [19]

DeMaagd et al.

[11] 3,991,884

[45] Nov. 16, 1976

[54] ARTICLE BIASING DISPLAY ROD

[75] Inventors: Howard E. DeMaagd, Grand Rapids; Thomas W. Sloan, Spring Lake, both of Mich.

[73] Assignee: John Thomas Batts, Inc., Zeeland, Mich.

[22] Filed: Dec. 11, 1975

[21] Appl. No.: 639,855

[52] U.S. Cl. ..... 211/1.5; 211/105.1; 211/123

[51] Int. Cl.[2] ..... A47F 3/08; A47H 1/02

[58] Field of Search ..... 211/1.5, 123, 124, 105.1, 211/113, 7, 4, 115, 164, 45; 248/251–272, 351, 352, 353, 201, 214

[56] References Cited

UNITED STATES PATENTS

| | | | |
|---|---|---|---|
| 1,460,685 | 7/1923 | Seaman | 211/164 |
| 2,442,099 | 5/1948 | Shoemaker et al. | 211/123 |
| 2,846,079 | 8/1958 | Leeper | 211/123 |
| 2,868,389 | 1/1959 | Friend | 211/123 |
| 2,969,881 | 1/1961 | Lilly | 211/105.3 |
| 3,481,483 | 12/1969 | Harvey et al. | 211/105.3 |
| 3,567,034 | 3/1971 | Mozelsio | 211/7 |

*Primary Examiner*—Roy D. Frazier
*Assistant Examiner*—Terrell P. Lewis
*Attorney, Agent, or Firm*—Price, Heneveld, Huizenga & Cooper

[57] ABSTRACT

A display arrangement for articles suspended from hanging devices includes a rod-like horizontal support having a plurality of longitudinally spaced, slot-like channels formed on both the upper and lower surfaces of an elongated rigid rod or pole. The slot-like channels are parallel to each other and are disposed at an acute angle relative to the longitudinal axes of the pole. The slot-like channels on the upper surface are in line with the slot-like channels formed on the lower surface. The channels space and arrange in parallel relationship the hanging devices at an acute angle to the axis of the support.

20 Claims, 6 Drawing Figures

ARTICLE BIASING DISPLAY ROD

BACKGROUND OF THE INVENTION

This invention relates to article display arrangements, and more particularly to article hanger rods for suspending a plurality of hook supported article hangers such, as for example, garment hangers.

It is common practice in clothing stores to display garments by hanging them on horizontally supported rods. The clothes are draped on hook supported garment hangers with the hooks suspended from the rods. Usually the garment rods extend between a pair of upright support members, with the garments suspended generally parallel to each other and perpendicular to the display rod.

As a result of this manner of display, customers are generally unable to view the individual garments without removing them from the rack or pushing adjacent garments together along the rod. Due to the number of garments placed on such display devices, the garments are subject to crushing and wrinkling when being viewed by a customer. Further, should a garment be removed from its hook-supported hanger, the hanger has a tendency to become entangled either in the adjacent garments or in the adjacent hangers.

Several examples may be found in the prior art of attempts to provide a garment display arrangement wherein uniform spacing of the garments may be maintained and the crushing or wrinkling of the garments may be avoided. For example, U.S. Pat. No. 2,895,618 to Nathan, entitled APPAREL HANGER SPACER, issued July 21, 1959 discloses an elongated shell-like member, having a semi-circular cross section and formed with a plurality of depressions. The depressions are longitudinally spaced and perpendicular to the center line of the shell-like member. The shell-like member is adapted to to be snapped down upon a clothes rod or pole with the protuberances or depressions extending upwardly. The hooks of the garment hangers are disposed within the depressions thereby evenly spacing the hangers. As is apparent, this arrangement requires a separate member to accomplish even spacing of the garments. Also, the garments will be maintained generally perpendicular to the clothes rod or pole. This latter feature impedes the ability of a customer or other person to view the garments on display since only the edges of the sleeve portions of the garments are readily visible.

Other prior art arrangements are known employing a spiral configuration to accomplish garment spacing. With these arrangements, since the spiral extends around the entire peripheral surface of the rod or pole, it is impossible to slide the garments along the pole should the need arise. Each garment hanger must be physically lifted from the rod and then placed in the desired position. It fails to provide the angular offset which displays the garments. It is also expensive.

A need therefore exists for a simple, easily manufactured garment display arrangement for supporting garment hangers whereby the problems heretofore experienced are substantially alleviated.

SUMMARY OF THE INVENTION

In accordance with the present invention, a garment display rod or pole is provided whereby hanger supported garments are evenly spaced along the length of a rod and positioned for easy viewing. Essentially, an elongated rigid pole is employed having a plurality of longitudinally spaced, slot-like channels on the upper peripheral surface thereof. The channels are adapted to receive the supporting hook of a garment hanger. The slot-like channels are positioned parallel to each other and at an acute angle relative to the longitudinal axis of the pole.

As a result of this arrangement, the hanger supported garments may be suspended at spaced positions along the pole. Further, the garments are partially offset from each other with each garment having a portion of its front projecting outwardly from the next adjacent garment and thus displayed for customer viewing.

DETAILED DESCRIPTION OF THE PREFERRED EMBODIMENT

Figure 1:
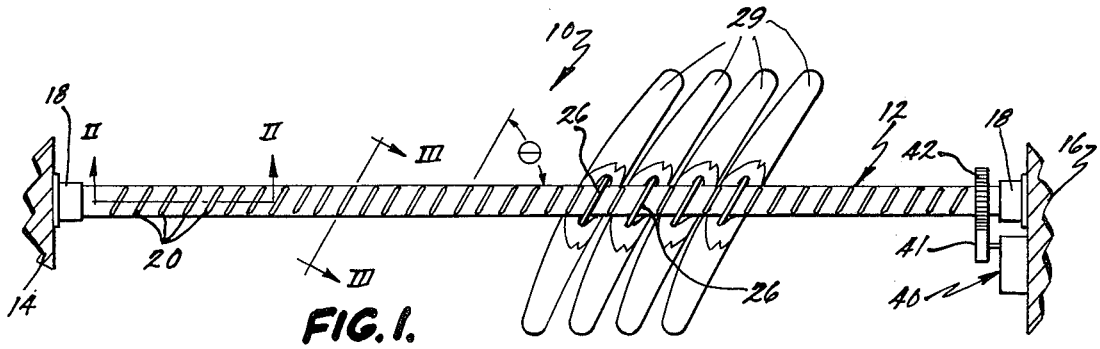
FIG. 1 is a plan view of a garment display rod in accordance with the present invention.
Figure 6:
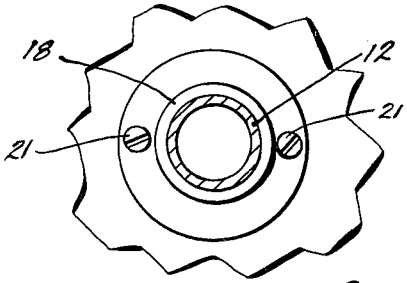
FIG. 6 is a cross-sectional view taken along line VI—VI of FIG. 5.

With reference to the drawings, FIG. 1 illustrates a garment display arrangement in accordance with the present invention and generally designated 10. The arrangement 10 includes an elongated pole or rod 12. The rod 12 is suspended in a horizontal position between a pair of schematically illustrated upright supports 14 and 16. As best seen in FIG. 6, the rod 12 is supported at each end by sockets 18. The sockets 18 are secured to the upright supports 14, 16 by suitable fasteners 21.

Figure 2:
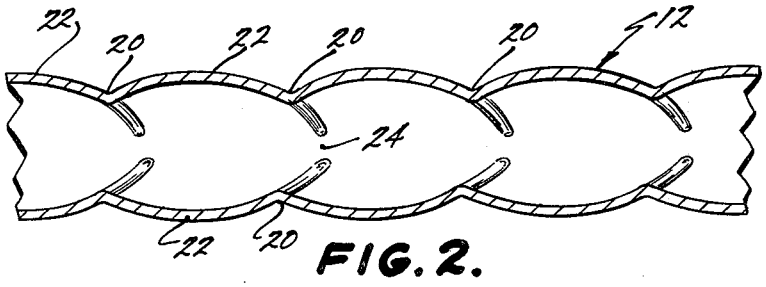
FIG. 2 is a fragmentary, cross sectional view taken along II—II of FIG. 1.
Figure 3:
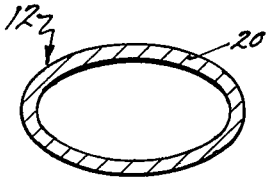
FIG. 3 is a cross-sectional view taken along line III—III of FIG. 1.
Figure 4:
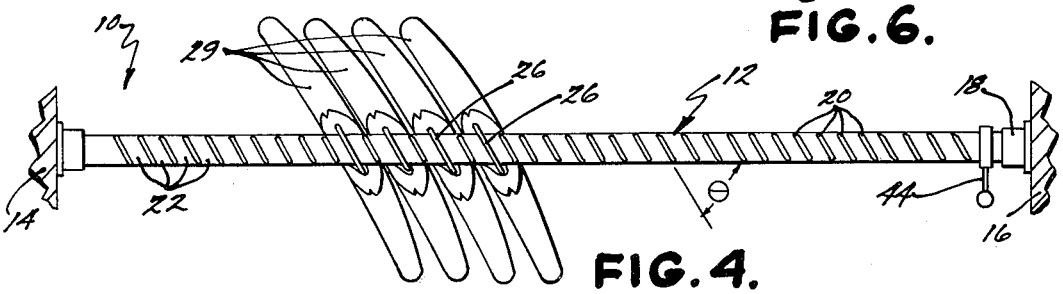
FIG. 4 is a plan view of the garment display rod of FIG. 1, rotated through 180°.
Figure 5:
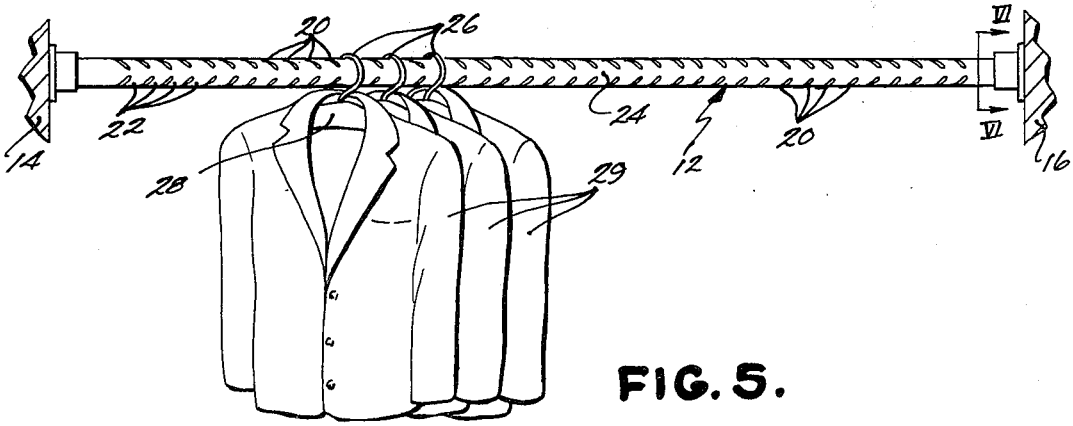
FIG. 5 is a side elevational view of a garment rod in accordance with the present invention showing the manner in which the garments are suspended.

As seen in FIGS. 2, 3 and 5, the elongated rod 12 is provided at diametrically oposed positions along its length with a plurality of slot-like channels 20. The channels 20 are illustrated as depressions formed in the rod 12. Each depression or channel 20 is separated by a protuberance 22. The slot-like channels are all parallel to one another and are evenly spaced at regular intervals along the longitudinal axis of the rod or pole 12. Further, as shown in FIGS. 1 and 4, the channels or indentations are positioned at an acute angle $\theta$ relative to the longitudinal axis of the rod 12. As is apparent from FIGS. 2 and 5, each channel of the set of slot-like channels on the upper surface of the rod is in the same vertical plane as a corresponding channel of the set of slot-like channels formed on the lower or undersurface of the rod. Further, the channels do not intersect one another, but each occupies only a portion of the periphery of the rod 12. The channels therefore define smooth, indentation-free surfaces 24 extending the length of the rod at diametrically opposed positions. The reason for this feature is more fully described below. The surfaces 24 are at the front and back of the rod when the rod is in its normal operating position.

Further, as seen in FIG. 3 the rod has a generally ellipsoidal cross section at the area of each slot-like channel. In the alternative, a solid rod or pole could be provided with the slot-like channels. The hollow tube is preferred for ease of forming, and for reduced cost and weight. The channels 20 are dimensioned so as to readily receive and retain the hook-like portions 26 of garment hangers 28. As a result, each garment 29 is positively spaced a predetermined distance along the rod 12 from every other garment, preventing crushing or wrinkling of the garments.

By mounting the rod 12 in sockets 18, as best seen in FIG. 6, the rod may readily be rotated to present either set of slot-like channels in a hanger supporting position. Therefore, the garments may be biased outwardly in either a right-hand direction as in FIG. 1 or in a left-hand direction as in FIGS. 4 and 5. This feature results in a display rod which is readily adaptable to a variety of display arrangements. For example, the display rod may be positioned along opposite sides of an aisle in a store with the garments opening outwardly towards a customer walking down the aisle. This permits a customer to readily view garments on the separate racks. Further, since the garments will be angled outwardly, a greater portion of the garments will be exposed for viewing. This feature is readily shown in FIG. 5. As previously set forth, with more conventional display rods wherein the garments are maintained perpendicular to the rod, only an extremely limited portion of the edge of the garment is exposed and available for viewing.

Further, as shown in the drawings, the slot-like channels effectively prevent longitudinal movement of the garments along the rod. Should it be desired, however, to slide the garments along the rod, the rod need merely be rotated through an angle of 90° to a position between the garment hanger retaining positions. As a result, one of the smooth, elongated surfaces 24 is presented on which the hangers are free to slide without any interference.

The garment display rod in accordance with the present invention has been illustrated as being in the form of a metal rod having a plurality of indentations formed therein. As will be readily apparent to one of ordinary skill in the art, a rod of different cross-sectional configuration could be provided with channel-like slots to obtain the same advantages. Further, the rod could be molded from a plastic-like material or could take the form of a tubular sleeve-like element which would be placed over and encase a separate tubular rod. Such modifications would not depart from the spirit and scope of the present invention.

In one exemplary form, the present invention could be produced from 1.00 inch O.D. steel tube of circular cross section and having a 0.085 inch wall thickness. The indentations would be formed in the tube at an angle $\theta$ of 60° and spaced at 1.25 inch intervals. The indentations or channels would have a 0.25 inch width and a depth of 0.125 inches. Finally the rod could be chrome plated to provide an aesthetically pleasing appearance.

By using a tube of circular cross section as the initial rod and forming the channels into the tube by suitable means such as punch and die, the cost of the product can be significantly reduced. The ends of the tube will be circular, permitting rotation. Circular stock is a standard product, readily available and less costly than stock of non-circular cross section such as elliptical. In die forming the channels, care should be taken not to deform the tube ends so the tube can be rotated when needed.

The device can be made to animate a display. The sockets 18 can be so made that they act as low-friction bearings, permitting the rod 12 to be readily rotated. Means can be provided for rotating the rod such as the motor and speed reducer 40 which can be mounted to drive the rod through the wheels 41 and 42 (FIG. 1). For simplicity and noise reduction the wheels 41 and 42 can be rubber coated to provide the necessary drive friction.

The drive should rotate the rod slowly, pausing when one of the smooth surfaces 24 is up. This pause permits the hangers and their hooks to assume a position normal to the axis of the rod, exhausting their momentum before entering the next channels and reversing their direction. This type of actuation can be accomplished by a suitable timing mechanism controlling the operation of the motor 40. The device can be extremely simple because it is never necessary to reverse the direction of drive. The operation can be made continuous or intermittent. If good bearings are provided in the sockets 18, a very small motor will be adequate.

Instead of a motor the rotation of the rod can be accomplished manually. To facilitate this a handle such as handle 44 (FIG. 4) can be attached to the rod, permitting the operator to rotate the rod 180°.

While this invention has been described as useful for displaying garments, it will be recognized that it is useful for displaying many other types of articles such for example as samples of carpeting, wall coverings, textiles, floor coverings. In fact, it can be used to display an article which is relatively thin flat when suspended. It is particularly useful for articles in which it is desirable to display both the front and back faces. It is also useful for displaying articles where contrast is desirable such as for example back-to-back display of carpet samples of the same design but of different colors.

It can therefore be seen that the garment hanger rod in accordance with the present invention is relatively simple in construction, serves to maintain garments evenly spaced, presents the garments for easy viewing, and is readily adaptable to a variety of display arrangements. It is expressly intended, therefore, that the foregoing description be considered illustrative of the preferred embodiment only. The true spirit and scope of the present invention will be determined by reference to the appended claims.

The embodiments of the invention in which an exclusive property or privilege is claimed are defined as follows:

1. An article of manufacture for suspending a plurality of hook supported article hangers, comprising:

an elongated rigid pole, the peripheral surface of said pole having a set of longitudinally spaced slot-like channels extending around a portion thereof, each channel being adapted to receive a hook of an article hanger, said channels being parallel to each other and positioned at an acute angle relative to the longitudinal axis of said pole whereby a plurality of hangers may be spaced along the pole and arranged so that the articles on the hangers may be easily viewed.

2. An article of manufacture as defined by claim 1 wherein said pole further includes a second set of longitudinally spaced slot-like channels extending around a portion thereof at diametrically opposed points to said first set, said channels of said second set being spaced from one another and extending transversely at an acute angle relative to the longitudinal center line of said pole whereby by rotating the pole through 180° the article hangers may be positioned in either a right-hand or left-hand angular direction with respect to the axis of said pole.

3. An article of manufacture as defined by claim 2 wherein each of said channels of said first set of channels is in the same vertical plane as a corresponding channel of said second set of channels.

4. An article of manufacture as defined by claim 3 wherein said pole has a generally circular cross section between said channels and a generally ellipsoidal cross section at said channels.

5. An article of manufacture as defined by claim 4 wherein said channels are evenly spaced along the longitudinal axis of said pole.

6. An article of manufacture as defined by claim 5 wherein said channels extend at an acute angle of about 60° relative to the longitudinal axis of said pole.

7. An article of manufacture as defined by claim 1 wherein said channels are evenly spaced slong the longitudinal axis of said pole.

8. An article of manufacture as defined by claim 1 wherein said channels extend at an acute angle of about 60° relative to the longitudinal axis of said pole.

9. An article of manufacture for suspending a plurality of hook supported article hangers, comprising:

an elongated rigid pole, said pole including a first set of depressions extending generally transversely around a portion of the upper peripheral surface thereof and a second set of depressions extending generally transversely around a portion of the lower surface thereof, the ends of the depressions of said first set being spaced from the ends of the depressions of said second set circumferentially of said pole, thereby defining a pair of longitudinally extending diametrically opposed smooth surfaces along said pole, each of said depressions being adapted to receive a hook of an article hanger whereby upon rotation of said pole to present one of said smooth surfaces upwardly, the article hangers may be slid freely along said pole.

10. An article of manufacture as defined by claim 9 wherein each of said depressions of each of said sets extends at an acute angle relative to the longitudinal axis of said pole.

11. An article of manufacture as defined by claim 10 wherein said depressions are evenly spaced along said pole and said depressions are generally parallel to each other.

12. An article of manufacture as defined by claim 11 wherein each of said depressions of said first set are in the same vertical plane as a depression of said second set.

13. An elongated, rigid means for suspending hook supported article hangers in spaced relationship along an elongated axis, said means having a plurality of parallel channels in one face thereof, said channels being at an acute angle to the elongated axis, said means having a plurality of identical channels in the opposite face thereof, each of the channels in the one face being in the same plane as one of the channels in the opposite face whereby inversion of said means will reverse the direction of angularity of garment hangers suspended therefrom.

14. The means for suspending hook supported article hangers as described in claim 13 wherein said channels in one face are separated from said channels in the opposite face by a pair of diametrically positioned smooth surfaces extending lengthwise of said means, an actuation member connected to said means for rotating the same.

15. The means for suspending hook supported article hangers as described in claim 14 wherein said actuation member comprises a manipulation element attached to said means.

16. The means for suspending hook supported article hangers as described in claim 14 wherein said actuation member comprises a motor drivingly connected to said means.

17. The means for suspending hook supported article hangers as described in claim 16 wherein said motor is equipped with a control member for temporarily interrupting the rotation of said means when one of said smooth surfaces is uppermost to permit article hangers thereon to assume a position generally normal to the axis of said means.

18. An elongated rod for suspending hook supported article hangers in spaced relationship, said means having a plurality of parallel channels in one face thereof, said channels being at an acute angle to the axis of said rod for supporting hangers on said rod at equally spaced intervals at an acute angle of the axis of said rod, said rod having a plurality of identical channels in the opposite face thereof, each of the channels in said one face being in the same plane as one of the channels in said other face whereby inversion of said means will reverse the direction of angularity of article hangers suspended therefrom; said channels in one face being separated from the channels in the opposite face by a pair of diametrically positioned smooth surfaces extending lengthwise of said rod; the ends of said rod being circular and constituting bearing-like support means and supporting it for rotation.

19. An elongated rod for suspending article hangers as described in claim 18 wherein means are provided for rotating said rod.

20. A method of displaying articles from a rod having a plurality of parallel aligned channels in opposite faces separated by diametrically opposite smooth surfaces extending lengthwise of the rod, the channels being at an angle to the axis of rod, including the steps of suspending articles from the rod by hangers having supports seated in the channels; rotating the rod to position one of the smooth surfaces uppermost, interrupting the rotation of the rod long enough for the hangers to pivot to a position generally normal to the axis of the rod while the supports are resting on the smooth surface; again rotating the rod to bring the channels of the opposite face into engagement with the supports and by engagement with the channels pivoting the hangers into an angular position reversed from that which they originally occupied.

* * * * *

UNITED STATES PATENT OFFICE

CERTIFICATE OF CORRECTION

Patent No. 3,991,884 Dated November 16, 1976

Inventor(s) Howard E. DeMaagd, et al.

It is certified that error appears in the above-identified patent and that said Letters Patent are hereby corrected as shown below:

Column 4, line 31:

After "thin" insert -- and --

Column 5, line 14:

" 4 " should be -- 1 --

Column 5, line 17:

" 5 " should be -- 1 --

Column 5, line 20:

" 1 " should be -- 4 --

Column 5, line 21:

"slong" should be -- along --

UNITED STATES PATENT OFFICE

CERTIFICATE OF CORRECTION

Patent No. 3,991,884 Dated November 16, 1976

Inventor(s) Howard E. DeMaagd, et al.

It is certified that error appears in the above-identified patent and that said Letters Patent are hereby corrected as shown below:

Column 5, line 24:

" 1 " should be -- 7 --

Column 6, line 42:

Delete "and"

Signed and Sealed this

*nineteenth* Day of *July 1977*

[SEAL]

*Attest:*

RUTH C. MASON
*Attesting Officer*

C. MARSHALL DANN
*Commissioner of Patents and Trademarks*